US008770281B2

(12) United States Patent
Arthur et al.

(10) Patent No.: US 8,770,281 B2
(45) Date of Patent: Jul. 8, 2014

(54) MULTIPLE INFILL WELLS WITHIN A GRAVITY-DOMINATED HYDROCARBON RECOVERY PROCESS

(75) Inventors: John E. Arthur, Calgary (CA); Simon D. Gittins, Bragg Creek (CA); Harbir S. Chhina, Calgary (CA)

(73) Assignee: Cenovus Energy Inc., Alberta (CA)

( * ) Notice: Subject to any disclaimer, the term of this patent is extended or adjusted under 35 U.S.C. 154(b) by 177 days.

(21) Appl. No.: 13/228,630

(22) Filed: Sep. 9, 2011

(65) Prior Publication Data

US 2012/0193094 A1 Aug. 2, 2012

Related U.S. Application Data

(60) Provisional application No. 61/381,793, filed on Sep. 10, 2010.

(30) Foreign Application Priority Data

Sep. 10, 2010 (CA) ..... 2714646

(51) Int. Cl.
*E21B 43/17* (2006.01)
*E21B 43/24* (2006.01)
*E21B 43/30* (2006.01)

(52) U.S. Cl.
USPC ..... 166/245; 166/268; 166/271; 166/272.2; 166/272.3; 166/272.6; 166/272.7; 166/400; 166/401

(58) Field of Classification Search
None
See application file for complete search history.

(56) References Cited

U.S. PATENT DOCUMENTS

| | | | | |
|---|---|---|---|---|
| 4,166,501 | A | 9/1979 | Korstad et al. | |
| 4,166,502 | A | 9/1979 | Hall et al. | |
| 4,166,503 | A | 9/1979 | Hall et al. | |
| 4,166,504 | A | 9/1979 | Brown et al. | |
| 4,177,752 | A | 12/1979 | Brown et al. | |
| 4,501,325 | A * | 2/1985 | Frazier et al. | 166/250.01 |
| 4,620,594 | A | 11/1986 | Hall | |
| 4,637,461 | A | 1/1987 | Hight | |

(Continued)

FOREIGN PATENT DOCUMENTS

| | | |
|---|---|---|
| CA | 1130201 | 7/1979 |
| CA | 2591498 | 6/2007 |

OTHER PUBLICATIONS

Chakrabarty, et al., SAG-D Process in the East Seniac Field: From Reservoir Characterization to Field Application (1998).

(Continued)

*Primary Examiner* — George Suchfield
(74) *Attorney, Agent, or Firm* — Jackson Walker, LLP

(57) ABSTRACT

A method for recovering hydrocarbons from a subterranean reservoir by operating a substantially gravity-controlled recovery process with two adjacent well pairs. Each well pair includes an injector well and a producer well. A mobilized zone forms around each well pair through the gravity-controlled recovery process, and a bypassed region forms between the adjacent well pairs when the respective mobilized zone of each well pair merge to form a common mobilized zone. A plurality of infill producer wells are provided in the bypassed region. The plurality of infill producer wells are operated to establish fluid communication between the plurality of infill producer wells and the common mobilized zone. Once fluid communication is established, the plurality of infill producer wells and the adjacent well pairs are operated under a substantially gravity-controlled recovery process, and hydrocarbons are recovered from the plurality of infill producer wells and from the producer wells.

39 Claims, 6 Drawing Sheets

(56) References Cited

U.S. PATENT DOCUMENTS

| | | | | |
|---|---|---|---|---|
| 4,646,824 | A * | 3/1987 | Huang et al. | 166/52 |
| 4,718,485 | A * | 1/1988 | Brown et al. | 166/50 |
| 4,727,937 | A | 3/1988 | Shum | |
| 6,257,334 | B1 | 7/2001 | Cyr et al. | |
| 7,527,096 | B2 * | 5/2009 | Chung et al. | 166/268 |
| 7,556,099 | B2 | 7/2009 | Arthur et al. | |
| 2006/0162922 | A1 * | 7/2006 | Chung et al. | 166/245 |
| 2007/0295499 | A1 * | 12/2007 | Arthur et al. | 166/245 |
| 2010/0193193 | A1 * | 8/2010 | Wagg et al. | 166/311 |
| 2011/0174488 | A1 * | 7/2011 | Morris et al. | 166/305.1 |

OTHER PUBLICATIONS

Chona, et al., SPE 37087 Evaluation of a Horizontal Infill Well in a Mature Cyclic-Steam Project (1996).

Polikar, Fast SAG-D Application in the Alberta Oil Sands Area (2005).

EnCana PowerPoint Presentation for the Foster Creek Development May 18, 2005.

EnCana PowerPoint Presentation for the Foster Creek Development May 30, 2006.

EnCana Foster Creek Approval/AEUB Application (2004).

* cited by examiner

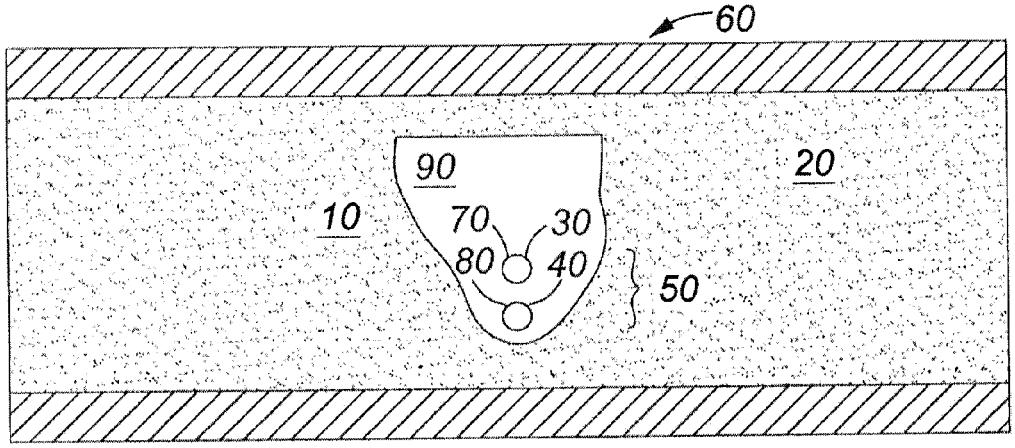
FIG. 1-Prior Art
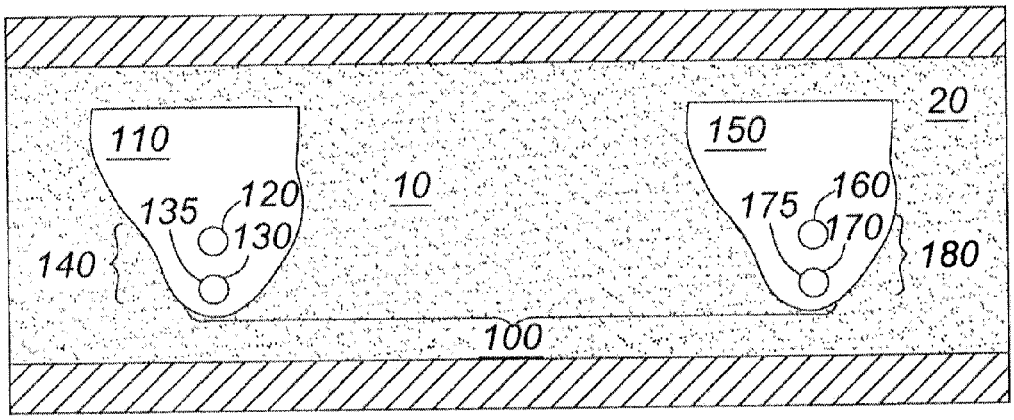
FIG. 2a-Prior Art
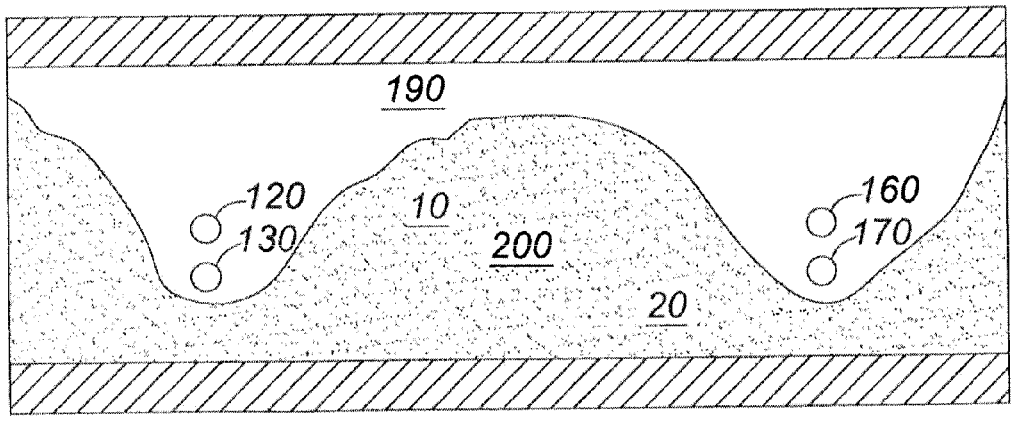
FIG. 2b-Prior Art

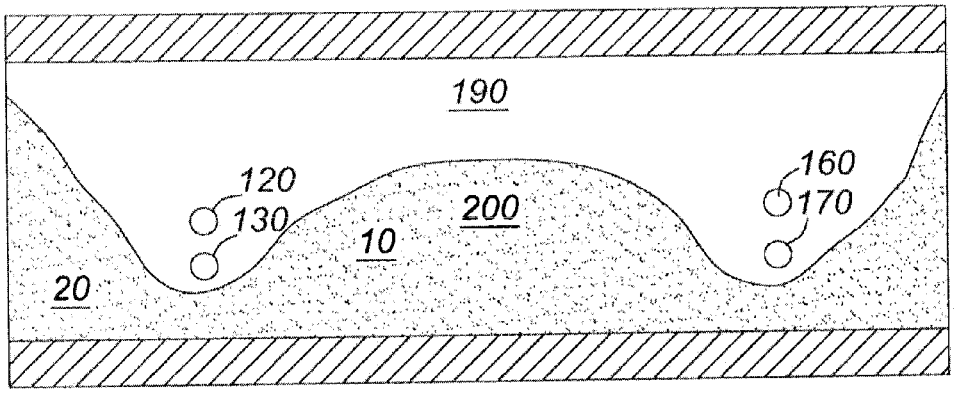
FIG. 2c-Prior Art
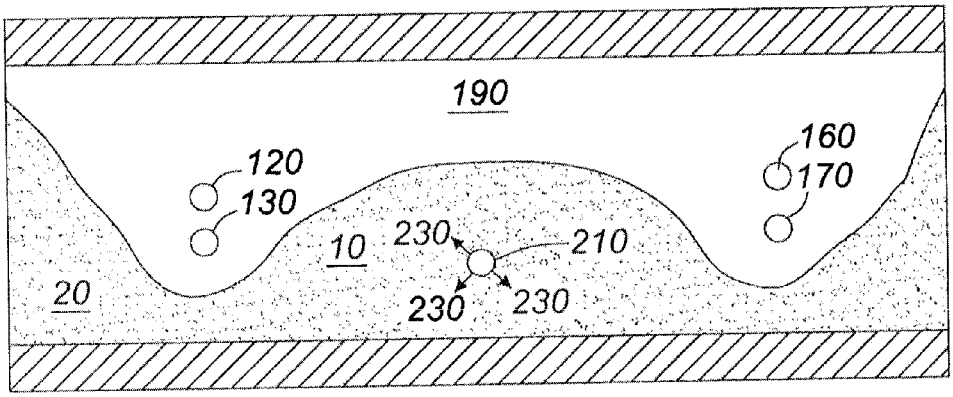
FIG. 3
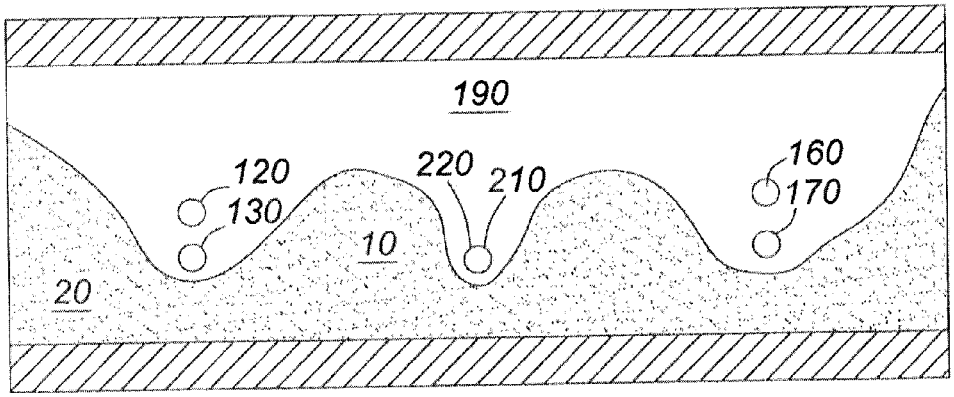
FIG. 4

MULTIPLE INFILL WELLS WITHIN A GRAVITY-DOMINATED HYDROCARBON RECOVERY PROCESS

CROSS REFERENCE TO RELATED APPLICATIONS

This application claims priority from Canadian Patent Application No. 2,714,646, filed Sep. 10, 2010. This application also claims the benefit of priority from U.S. Provisional Patent Application No. 61/381,793 filed Sep. 10, 2010, which is incorporated herein by reference in its entirety.

FIELD

The present invention relates generally to recovery processes for hydrocarbons from an underground reservoir or formation. More particularly, the present invention relates to recovery processes for heavy oil or bitumen from an underground reservoir or formation. More specifically still, the present invention relates to a recovery process employing between two and four infill wells, which communicate with adjacent well pairs that are already operating under a gravity-dominated recovery process. The infill wells operate along with the adjacent wells under a flow regime which is gravity-dominated.

BACKGROUND

A number of inventions have been directed to the recovery of hydrocarbons from an underground reservoir or formation.

Canadian Patent No. 1,130,201 (Butler) teaches a thermal method for recovering normally immobile oil from an oil sand deposit utilizing two wells, one for injection of heated fluid and one for production of liquids. Thermal communication is established between the wells and oil drains continuously by gravity to the production well where it is recovered.

U.S. Pat. No. 6,257,334 (Cyr. et al.) teaches a thermal process for recovery of viscous oil from a subterranean reservoir involving the use of an offset well. A pair of vertically spaced, parallel, co-extensive, horizontal injection and production wells and a laterally spaced, horizontal offset well are provided. The injection and production wells are operated as a Steam-Assisted Gravity Drainage (SAGD) pair. Cyclic steam stimulation is practiced at the offset well. The steam chamber developed at the offset well tends to grow toward the steam chamber of the SAGD pair, thereby developing communication between the SAGD pair and the offset well. The offset well is then converted to producing heated oil and steam condensate under steam trap control as steam continues to be injected through the injection well.

U.S. Pat. No. 7,556,099 (Arthur et al) describes a thermal process for recovery of viscous oil from a subterranean reservoir whereby an infill well is provided in a bypassed region between adjacent well pairs, the bypassed region formed when respective mobilized zones of the adjacent well pairs merge to form a common mobilized zone. In a preferred embodiment, injection and production well pairs are operated as a Steam-assisted Gravity Drainage (SAGD) pair. The infill well is operated to establish fluid communication between the infill well and the common mobilized zone. Once such fluid communication is established, the infill well and the adjacent well pairs form a single hydraulic and thermal unit operating under a gravity-dominated recovery process.

U.S. Pat. No. 4,727,937 (Shum et al) describes a steam based process for recovery of hydrocarbons which employs a plurality of infill wells. Four horizontal producer wells are drilled along the sides of a rectangle. A vertical steam injection well is then placed in the center of the well pattern, and four vertical infill wells are located midway between the central injection well and the four corners of the rectangular well pattern. Steam is initially injected through the central injection well and production is taken at the four infill wells. After the injection of about 0.5 to about 1.0 pore volumes of steam through the central injection well, the central injector is converted to water, the infill production wells are converted to steam injection, and production is taken from the horizontal wells. This patent differs from both the prior art cited above as well as from the present invention in several material aspects, including the roles and functions of the infill wells. However, most notably, this patent involves horizontal displacement of hydrocarbon by steam and does not employ gravity drainage or a gravity-dominated recovery process.

U.S. Pat. No. 4,637,461 (Hight) describes a 9-spot pattern involving vertical wells at the center, corners, and mid-point of the sides of the pattern, as well as eight horizontal wells, each horizontal well drilled between a corner and a side vertical well. In addition, vertical infill wells are located mid-way between the central injector and the corner wells. The recovery process described in the patent involves horizontal displacement. The option to complete the wells lower in the formation to recognize the tendency of steam to rise within the formation is also described. However, this is still totally within the context of a recovery process which relies on horizontal displacement. As such, this patent does not employ, or largely rely on, gravity drainage or a gravity-dominated recovery mechanism.

U.S. Pat. No. 4,620,594 (Hall) describes a set of techniques aimed at recovering additional oil after steam override between an injector and a producer in a steam displacement process (i.e., steam drive) has resulted in a condition whereby continued operation of the injector-producer well pair will not provide an economic means of recovering the bypassed oil. The techniques described for recovering the bypassed oil include re-perforating the two wells and reversing their roles, introducing a fluid to block or impede flow in the high mobility override zone and introducing a single infill well. However, all of these techniques, including specifically the use of a single infill well, are described within the context of a displacement process, with no reference to a gravity drainage mechanism or gravity-dominated recovery process.

U.S. Pat. No. 4,166,501 (Korstad et al), describes a steam displacement (i.e., steam drive) oil recovery process employing an injection well and a production well with an infill well being located in the recovery zone between the injection well and production well. Steam is injected into the injection well and oil recovered from the production well until steam breakthrough occurs at the production well, after which the infill well is converted from a producer well to an injector well, and steam is injected into the infill well with production being continued from the production well. Application of Korstad et al results in a "significant increase in the vertical conformance of the steam drive oil recovery process". U.S. Pat. Nos. 4,166,502; 4,166,503; 4,166,504; and 4,177,752 describe variations in the steam drive enhanced oil recovery process employing infill wells described in U.S. Pat. No. 4,166,501 above. In all cases, the basic recovery process is steam displacement, and there is no reference to employing a gravity drainage mechanism or a gravity-dominated recovery process.

It is, therefore, desirable to provide an improved gravity-dominated recovery process employing multiple infill wells.

SUMMARY

It is an object of the present invention to improve upon the recovery processes taught by the prior art.

Specifically, the present invention extends the concept of a single infill well in a gravity-dominated recovery process as taught by the prior art, to include a multiplicity of infill wells. For a variety of technical and economic circumstances it is possible to define an optimum number of infill wells for improved performance. In this context, optimum refers to a maximum value that is characteristically measured by means of any one or all of an assemblage of technical and economic metrics, such as Net Present Value (NPV), Recovery Efficiency (Ri), and Cumulative Steam-Oil Ration (CSOR).

Generally, the present invention relates to a method or process for recovery of viscous hydrocarbons from a subterranean reservoir, the subterranean reservoir having been penetrated by wells that have or had been operating under a gravity-controlled or gravity-dominated recovery process, such as, but not limited to, Steam Assisted Gravity Drainage, commonly referred to as SAGD. In the context of the present invention, and consistent with current practice of the art, such as field operation of the SAGD process, reference to a gravity-controlled or gravity-dominated recovery process implies a process whose flow mechanisms are predominantly gravity-controlled and whose techniques of operation are largely oriented toward ultimately maximizing the influence of gravity drainage because of its inherent efficiency.

The present invention involves placement and operation of between two and four infill wells in the subterranean reservoir where the principle or initial recovery mechanism is a gravity-controlled process such as, but not limited to, SAGD, so as to access that portion of said reservoir whose hydrocarbons have not or had not been recovered in the course of operation of the prior configuration of wells under the abovementioned gravity-controlled recovery process. That portion of the reservoir is referred to herein as the bypassed region. Following operation of the gravity-controlled recovery process for a suitable period of time using the prior configuration of wells, also referred to herein as the adjacent well pairs, the infill wells, either jointly or individually, are activated. The principle that underlies the choice of timing of activation of the between two and four infill wells in relation to operation of the prior adjacent wells involves ensuring that the mobilized zones at the adjacent wells have merged with each other so that they have first formed a single hydraulic entity, otherwise referred to as a common mobilized zone, prior to activation of the infill wells. Thus, when the infill wells are activated, their communication with the adjacent wells will occur when they access the common mobilized zone.

In a first aspect, the present invention provides a method of producing hydrocarbons from a subterranean reservoir including:

operating a first injector-producer well pair under a substantially gravity-controlled recovery process, the first injector-producer well pair forming a first mobilized zone in the subterranean reservoir, the first injector-producer well pair comprising a first injector well and a first producer well;

operating a second injector-producer well pair under a substantially gravity-controlled recovery process, the second injector-producer well pair forming a second mobilized zone in the subterranean reservoir, the second injector-producer well pair comprising a second injector well and a second producer well, the first injector-producer well pair and the second injector-producer well pair together being adjacent well pairs;

providing two to four infill producer wells in a bypassed region, the bypassed region having formed between the adjacent well pairs when the first mobilized zone and the second mobilized zone merge to form a common mobilized zone;

operating the two to four infill producer wells to establish fluid communication between the two to four infill producer wells and the common mobilized zone;

operating the two to four infill producer wells and the adjacent well pairs under a substantially gravity-controlled recovery process; and recovering hydrocarbons from the two to four infill producer wells, and from the first producer well and the second producer well.

In an embodiment, the present invention provides a method of producing hydrocarbons from a subterranean reservoir wherein the two to four infill producer wells comprise two infill producer wells.

In an embodiment, the present invention provides a method of producing hydrocarbons from a subterranean reservoir wherein the two to four infill producer wells comprise three infill producer wells.

In an embodiment, the present invention provides a method of producing hydrocarbons from a subterranean reservoir wherein the two to four infill producer wells comprise three infill producer wells and wherein the three infill producer wells comprise two outer infill wells and a central infill producer well, and further comprising injecting a mobilizing fluid through the central infill producer well prior to operating the three infill producer wells and the adjacent well pairs under a substantially gravity-controlled recovery process.

In an embodiment, the present invention provides a method of producing hydrocarbons from a subterranean reservoir wherein the two to four infill producer wells comprise three infill producer wells and wherein:

the first producer well is at a first depth;

the second producer well is at the first depth; and the three infill producer wells comprising two outer infill wells and a central infill producer well, the two outer infill wells being located at a substantially similar depth to the first depth, and the central infill producer well being located at a second depth, the second depth being closer to the surface than the first depth.

In an embodiment, the present invention provides a method of producing hydrocarbons from a subterranean reservoir wherein the two to four infill producer wells comprise three infill producer wells and wherein:

the first producer well is at a first depth;

the second producer well is at the first depth; and the three infill producer wells comprising two outer infill wells and a central infill producer well, the two outer infill wells being located at a substantially similar depth to the first depth, and the central infill producer well being located at a second depth, the second depth being closer to the surface than the first depth and wherein the second depth is between about two and about four meters closer to the surface than the first depth.

In an embodiment, the present invention provides a method of producing hydrocarbons from a subterranean reservoir wherein the two to four infill producer wells comprise four infill producer wells.

In an embodiment, the present invention provides a method of producing hydrocarbons from a subterranean reservoir wherein the two to four infill producer wells comprise four infill producer wells and wherein the four infill producer wells comprise two outer infill wells and two central infill producer wells, and further comprising injecting a mobilizing fluid through one or more of the two central infill producer wells prior to operating the three infill producer wells and the adjacent well pairs under a substantially gravity-controlled recovery process.

In an embodiment, the present invention provides a method of producing hydrocarbons from a subterranean reservoir wherein the subterranean reservoir has a pay thickness of at least 25 meters.

In an embodiment, the present invention provides a method of producing hydrocarbons from a subterranean reservoir wherein the pay thickness is at least 35 meters.

In an embodiment, the present invention provides a method of producing hydrocarbons from a subterranean reservoir wherein the adjacent well pairs are separated by a distance of between substantially 90 and substantially 130 meters.

In an embodiment, the present invention provides a method of producing hydrocarbons from a subterranean reservoir wherein the adjacent well pairs are separated by a distance of substantially 100 or substantially 120 meters.

In an embodiment, the present invention provides a method of producing hydrocarbons from a subterranean reservoir wherein the adjacent well pairs are separated by a distance of between substantially 180 and substantially 260 meters.

In an embodiment, the present invention provides a method of producing hydrocarbons from a subterranean reservoir wherein the adjacent well pairs are separated by a distance of substantially 200 or substantially 240 meters.

In an embodiment, the present invention provides a method of producing hydrocarbons from a subterranean reservoir wherein the two to four infill producer wells are operated jointly to establish fluid communication between the two to four infill producer wells and the common mobilized zone.

In an embodiment, the present invention provides a method of producing hydrocarbons from a subterranean reservoir wherein each of the two to four infill producer wells are operated individually to establish fluid communication between the two to four infill producer wells and the common mobilized zone.

In an embodiment, the present invention provides a method of producing hydrocarbons from a subterranean reservoir wherein the two to four infill producer wells are operated jointly under a substantially gravity-controlled recovery process.

In an embodiment, the present invention provides a method of producing hydrocarbons from a subterranean reservoir wherein each of the two to four infill producer wells are operated individually under a substantially gravity-controlled recovery process.

In an embodiment, the present invention provides a method of producing hydrocarbons from a subterranean reservoir wherein hydrocarbons are produced from the two to four infill producer wells to establish fluid communication between the two to four infill producer wells and the common mobilized zone.

In an embodiment, the present invention provides a method of producing hydrocarbons from a subterranean reservoir wherein a mobilizing fluid is injected into one or more of the two to four infill producer wells to establish fluid communication between the two to four infill producer wells and the common mobilized zone.

In an embodiment, the present invention provides a method of producing hydrocarbons from a subterranean reservoir wherein a mobilizing fluid is injected into one or more of the two to four infill producer wells to establish fluid communication between the two to four infill producer wells and the common mobilized zone and wherein the mobilizing fluid comprises steam or is substantially steam.

In an embodiment, the present invention provides a method of producing hydrocarbons from a subterranean reservoir wherein a mobilizing fluid is injected into one or more of the two to four infill producer wells to establish fluid communication between the two to four infill producer wells and the common mobilized zone and wherein the mobilizing fluid is a light hydrocarbon or a combination of light hydrocarbons.

In an embodiment, the present invention provides a method of producing hydrocarbons from a subterranean reservoir wherein a mobilizing fluid is injected into one or more of the two to four infill producer wells to establish fluid communication between the two to four infill producer wells and the common mobilized zone and wherein the mobilizing fluid includes both steam and a light hydrocarbon or light hydrocarbons, either as a mixture or as a succession or alternation of fluids.

In an embodiment, the present invention provides a method of producing hydrocarbons from a subterranean reservoir wherein a mobilizing fluid is injected into one or more of the two to four infill producer wells to establish fluid communication between the two to four infill producer wells and the common mobilized zone and wherein the mobilizing fluid comprises hot water.

In an embodiment, the present invention provides a method of producing hydrocarbons from a subterranean reservoir wherein a mobilizing fluid is injected into one or more of the two to four infill producer wells to establish fluid communication between the two to four infill producer wells and the common mobilized zone and wherein the mobilizing fluid comprises both hot water and a light hydrocarbon or light hydrocarbons, introduced into the hydrocarbon formation either as a mixture or as a succession or alternation of fluids.

In an embodiment, the present invention provides a method of producing hydrocarbons from a subterranean reservoir wherein a mobilizing fluid is injected into one or more of the two to four infill producer wells to establish fluid communication between the two to four infill producer wells and the common mobilized zone and wherein the mobilizing fluid is injected at a pressure and flow rate sufficiently high to effect a fracturing or dilation or parting of the subterranean reservoir matrix outward from some or all of the infill producer wells, thereby exposing a larger surface area to the mobilizing fluid.

In an embodiment, the present invention provides a method of producing hydrocarbons from a subterranean reservoir wherein a mobilizing fluid is injected into one or more of the two to four infill producer wells to establish fluid communication between the two to four infill producer wells and the common mobilized zone and wherein the mobilizing fluid and a gaseous fluid are injected concurrently, or wherein the injection of the mobilizing fluid is terminated or interrupted, and a gaseous fluid is injected into the common mobilized zone to maintain pressure within the common mobilized zone, while continuing to produce hydrocarbons under a predominantly gravity-controlled recovery process.

In an embodiment, the present invention provides a method of producing hydrocarbons from a subterranean reservoir wherein a mobilizing fluid is injected into one or more of the two to four infill producer wells to establish fluid communication between the two to four infill producer wells and the common mobilized zone and wherein the mobilizing fluid and a gaseous fluid are injected concurrently, or wherein the injection of the mobilizing fluid is terminated or interrupted, and a gaseous fluid is injected into the common mobilized zone to maintain pressure within the common mobilized zone, while continuing to produce hydrocarbons under a predominantly gravity-controlled recovery process wherein the gaseous fluid comprises natural gas.

In an embodiment, the present invention provides a method of producing hydrocarbons from a subterranean reservoir wherein a mobilizing fluid is circulated through one or more of the two to four infill producer wells to establish fluid communication between the two to four infill producer wells and the common mobilized zone.

In an embodiment, the present invention provides a method of producing hydrocarbons from a subterranean reservoir wherein a mobilizing fluid is circulated through one or more of the two to four infill producer wells to establish fluid communication between the two to four infill producer wells and the common mobilized zone wherein the mobilizing fluid comprises steam.

In an embodiment, the present invention provides a method of producing hydrocarbons from a subterranean reservoir wherein the gravity-controlled recovery process is Steam-assisted Gravity Drainage (SAGD).

In an embodiment, the present invention provides a method of producing hydrocarbons from a subterranean reservoir wherein the two to four infill producer wells and the adjacent well pairs are substantially horizontal.

In an embodiment, the present invention provides a method of producing hydrocarbons from a subterranean reservoir wherein the two to four infill producer wells and the adjacent well pairs are substantially horizontal and wherein the trajectories of the substantially horizontal two to four infill producer wells and the adjacent well pairs are approximately parallel.

In an embodiment, the present invention provides a method of producing hydrocarbons from a subterranean reservoir wherein the infill producer wells and the adjacent well pairs, constituting a well group, are provided on a repeated pattern basis either longitudinally or laterally or both, to form a multiple of well groups.

In a further aspect, the present invention provides a method of producing hydrocarbons from a subterranean reservoir including:

- operating a first injector-producer well pair under a substantially gravity-controlled recovery process, the first injector-producer well pair forming a first mobilized zone in the subterranean reservoir, the first injector-producer well pair comprising a first injector well and a first producer well;
- operating a second injector-producer well pair under a substantially gravity-controlled recovery process, the second injector-producer well pair forming a second mobilized zone in the subterranean reservoir, the second injector-producer well pair comprising a second injector well and a second producer well, the first injector-producer well pair and the second injector-producer well pair together being adjacent well pairs;
- providing two to four infill producer wells in a bypassed region, the bypassed region having formed between the adjacent well pairs when the first mobilized zone and the second mobilized zone merge to form a common mobilized zone;
- recovering hydrocarbons from the bypassed region from the two to four infill producer wells; and
- recovering hydrocarbons from the first producer well and the second producer well.

In an embodiment, the present invention provides a method of producing hydrocarbons from a subterranean reservoir wherein further including the step of ceasing to recover hydrocarbons from the bypassed region from the two to four infill producer wells when the SOR reaches a selected value.

In an embodiment, the present invention provides a method of producing hydrocarbons from a subterranean reservoir wherein the step of recovering hydrocarbons from the bypassed region from the two to four infill producer wells includes injecting a mobilizing fluid through the two to four infill producer wells.

In an embodiment, the present invention provides a method of producing hydrocarbons from a subterranean reservoir wherein the step of recovering hydrocarbons from the bypassed region from the two to four infill producer wells includes injecting a mobilizing fluid through the two to four infill producer wells, and further including the step of ceasing to inject mobilizing fluid when fluid communication is established between the bypassed region and the common mobilized zone.

In a further aspect, the present invention provides a method of producing hydrocarbons from a subterranean reservoir having a producible amount of hydrocarbons in place, comprising:

- operating a first injector-producer well pair under a substantially gravity-controlled recovery process, the first injector-producer well pair forming a first mobilized zone in the subterranean reservoir, the first injector-producer well pair comprising a first injector well and a first producer well;
- operating a second injector-producer well pair under a substantially gravity-controlled recovery process, the second injector-producer well pair forming a second mobilized zone in the subterranean reservoir, the second injector-producer well pair comprising a second injector well and a second producer well, the first injector-producer well pair and the second injector-producer well pair together being adjacent well pairs;
- providing two to four infill producer wells in a bypassed region, the bypassed region having formed between the adjacent well pairs when:
  - the first mobilized zone and the second mobilized zone merge to form a common mobilized zone; and
  - between about 40 percent and about 45 percent of the producible amount of hydrocarbons in place have been recovered from the adjacent well pairs;
- operating the two to four infill producer wells to establish fluid communication between the infill producer wells and the common mobilized zone;
- operating the two to four infill producer wells and the adjacent well pairs under a substantially gravity-controlled recovery process; and
- recovering hydrocarbons from the two to four infill producer wells, and from the first producer well and the second producer well.

In a further aspect, the present invention provides a method of producing hydrocarbons from a subterranean reservoir, comprising:

- operating a first injector-producer well pair under a substantially gravity-controlled recovery process, the first injector-producer well pair forming a first mobilized zone in the subterranean reservoir, the first injector-producer well pair comprising a first injector well and a first producer well, the first injector-producer well comprising a first completion interval, the first completion interval being substantially horizontal;
- operating a second injector-producer well pair under a substantially gravity-controlled recovery process, the second injector-producer well pair forming a second mobilized zone in the subterranean reservoir, the second injector-producer well pair comprising a second injector well and a second producer well, the second injector-producer well comprising a second completion interval, the second completion interval being substantially horizontal, the first injector-producer well pair and the second injector-producer well pair together being adjacent well pairs;

providing two to four series of substantially vertical infill producer wells, the completion intervals of the substantially vertical infill producer wells being in a bypassed region and approximating the effect on performance that would be achieved by the presence of two to four horizontal infill producer wells, the bypassed region having formed between the adjacent well pairs when the first mobilized zone and the second mobilized zone merge to form a common mobilized zone;

operating the two to four series of substantially vertical infill producer wells to establish fluid communication between the two to four infill producer wells and the common mobilized zone;

operating the two to four series of substantially vertical infill producer wells and the adjacent well pairs under a substantially gravity-controlled recovery process; and recovering hydrocarbons from the two to four series of substantially vertical infill producer wells, and from the first producer well and the second producer well.

BRIEF DESCRIPTION OF THE DRAWINGS

Embodiments of the present invention will now be described, by way of example only, with reference to the attached Figures, wherein:

FIG. 1 is a cross-section view of a subterranean formation, depicting a single injector-producer well pair in a subterranean formation utilizing a SAGD recovery process;

FIG. 2*a*-2*c* is a cross-section view, as in FIG. 1, depicting two adjacent injector-producer well pairs in a subterranean formation utilizing a SAGD recovery process, depicting the progression over time;

FIG. 3 is a cross-section view, as in FIG. 2, depicting a method using a single infill well wherein the infill well is not yet in fluid communication with a common mobilized zone;

FIG. 4 is a cross-section view, as in FIG. 2, depicting a method using a single infill well wherein the infill well is in fluid communication with a common mobilized zone;

Figure 5:
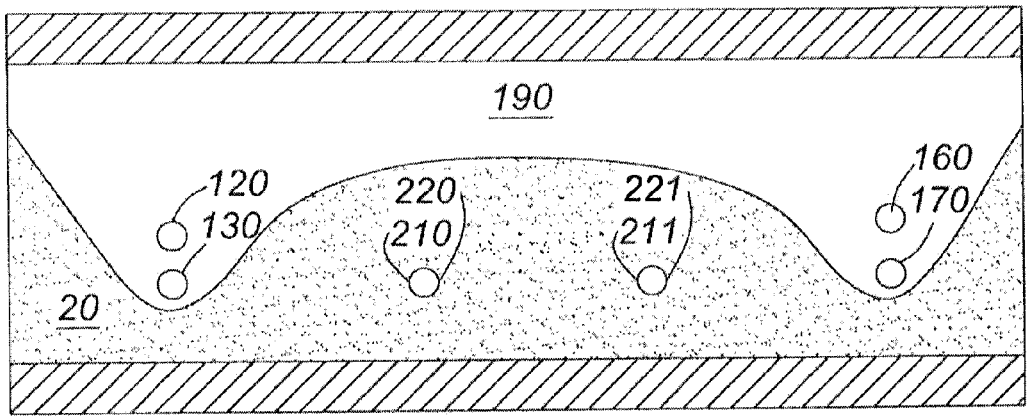
FIG. 5 is a cross-section view depicting an embodiment of the present invention, including a common mobilized zone resulting from merger of mobilized zones of adjacent well pairs, and with two infill wells in a bypassed region between the two adjacent well pairs, wherein the infill wells are not yet in fluid communication with the common mobilized zone.

It should be noted that the foregoing figures provide a highly schematic representation of the well arrangements and, for illustrative simplicity, intentionally omit certain features that, to one skilled in the art, are well known concomitants of gravity-dominated recovery processes. For example, in the case of both the SAGD producers and the infill producers, it is well understood that these are operated under a condition that is known as steam trap control. Under steam trap control, each producer is intentionally operated so that there is always a liquid level, or vapor-liquid interface, above it (i.e., so that the completion interval of the producer is totally submerged in a liquid environment). Thus, a representation of the vapor-liquid interface has been intentionally omitted from these schematic illustrations, but will be understood to be present by one skilled in the art

DETAILED DESCRIPTION

Generally, the present invention relates to a process for recovering viscous hydrocarbons, such as bitumen or heavy oil, from a subterranean reservoir which is, or had been, subject to a gravity-controlled recovery process, and which gravity-controlled recovery process was resulting or had resulted in the bypassing of hydrocarbons in a bypassed region due to the imperfect sweep efficiency or conformance of the flow patterns of said process, or for other reasons.

Difficulty of Predicting Optimum Number of Infill Wells on a Case-by-Case Basis

Because of hydraulic communication among all of the wells in a gravity-dominated operating unit, such as, for example, the adjacent well pairs in a SAGD operation, on the one hand, and any infill wells that may be active in the intervening bypassed region between the SAGD well pairs, on the other, operations at any well within this unit will influence operations elsewhere within this same hydraulically communicating unit. Therefore, for example, the addition of a second infill well in the bypassed region, or a second and a third infill in the bypassed region, would be expected to diminish the production that would have otherwise been experienced at the other producers, had further infill wells not been present. Therefore, the performance of the aggregate of wells constituting the hydraulic unit will be non-linear with respect to the addition of successive infill wells. It is surprising that introduction of a second infill well, or of a third or fourth infill well will maintain or improve the CSOR compared to the case of a single infill well.

It is difficult to establish an optimum number or range of infill wells for a given situation due to reservoir (solid and fluid) characteristics. A high degree of variability in lithology is the norm in most reservoirs, and is emphatically the case in heavy oil and oil sands reservoirs such as those located in Canada. In addition, viscosity characteristics generally, and specifically viscosity of the heavy oil or bitumen at original conditions, may exhibit marked variations from one reservoir to another, and indeed within a given reservoir.

Further contributing to this non-linearity in performance characteristics, or performance metrics, with respect to the addition of infill wells, and the corresponding difficulty in defining an optimum number or range, is the matter of well spacing. For example, SAGD performance is a non-linear function of well spacing. Thus, wider spacing between SAGD well pairs, with a larger associated oil in place, will extend the operating life of each well pair and will tend to increase SOR when compared to a smaller spacing because of the longer period during which heat is resident at the top of the reservoir where heat losses are large. Also, depending on variations in lithology, the wider spacing may compromise conformance (volumetric sweep efficiency) and ultimately cause a deterioration in performance when compared to a reduced spacing configuration. The effect on technical performance of adding infill wells in SAGD configurations where wider spacing is employed is not determinable by extension of results which may be valid for the case of smaller spacing.

The abovementioned technical non-linearities are further accentuated when economic considerations are introduced. For example, for a given set of technical conditions, the number of infill wells that may be optimal will depend on economic factors such as oil netback (the value realized by the producer on a barrel of oil at the plant gate), among others. Thus, if the market is such that higher netbacks are realized, directionally this could incentivize the drilling of additional infill wells.

Our invention comprises the application of the discovery that, notwithstanding an exceptionally large and highly variable set of technical and economic factors which can influence the determination of an optimum number of infill wells, that optimization can nevertheless be achieved. Preferably, the method utilizes either two or three infill wells between two adjacent SAGD well pairs. Preferably, the infill wells are located, and more or less uniformly distributed, in the intervening space between said well pairs. The number of infill wells will be selected by those practiced in the art based on their own specific set of considerations.

The present invention affords flexibility. For example, when drilling the initial SAGD well pairs in a development, the economic optimum well spacing is unknown due to the highly variable price of heavy oil/bitumen that is frequently experienced over the life of the wells. As high oil prices may push the optimum to smaller well spacing, and low oil prices may push it to larger spacing, the use of multiple infill wells allows an operator skilled in the art to drill SAGD well pairs on a fairly large spacing, in the case of low prices, while retaining the flexibility to add, at a later stage or stages, additional infill wells in accordance with the prevailing oil price to optimize oil recovery and SOR.

The present invention applies to any known heavy oil deposits and to oil sands deposits, such as those in the Foster Creek oil sand deposit and those in the Christina Lake oil sand deposit, both located in Alberta, Canada.

In a preferred embodiment, two horizontal wells, referred to herein as the infill wells, are completed in a completion interval in the bypassed region where hydrocarbons have been bypassed by a gravity-controlled recovery process, and thereafter mobilizing the hydrocarbon in those otherwise-bypassed regions in such a way that the infill wells achieve and remain in hydraulic communication with adjacent gravity-controlled patterns. The timing of activation of the infill wells is such that the adjacent well pairs have first operated for a sufficient period of time to ensure that their surrounding mobilized zones have merged to form a single hydraulic entity, after which time the infill wells may be operated so as to access that entity. The infill wells and adjacent wells are then operated in aggregate as a hydraulic and thermal unit so as to increase overall hydrocarbon recovery. Specifically, the infill wells, through their communication with adjacent patterns, are able to recover additional hydrocarbons by providing an offset means of continuing the gravity drainage process originally implemented in those adjacent patterns.

Gravity-Controlled Recovery Processes

Referring to FIG. 1 by way of example, typically the principal or initial gravity-controlled recovery process for the recovery of viscous hydrocarbons, such as bitumen or heavy oil 10 from a subterranean reservoir 20 will involve an injection well 30 and a production well 40, commonly referred to as an injector-producer well pair 50 with the production well 40 directly underlying the injection well 30. The injection well 30 extends between the surface 60 and a completion interval 70 in the subterranean reservoir 20, forming an injection well trajectory. The production well 40 extends between the surface 60 and a completion interval 80 in the subterranean reservoir 20, forming a production well trajectory. Typically, within the reservoir, the injection well trajectory and the production well trajectory are generally parallel, at least in a substantial portion of their respective completion intervals. As one skilled in the art will recognize, the figures herein represent the completion intervals of the wells only, as is customary to one skilled in the art.

The vertical interval or space between the injection well 30 and the production well 40 is dictated by practices already well known to one skilled in the art when, for example. SAGD is the process. A mobilized zone 90 extends between the injection well 30 and the production well 40 and, with continued operation of the recovery process, extends laterally and vertically beyond the flow path between injection well 30 and production well 40 and into the subterranean reservoir 20.

FIG. 2 illustrates a typical progression over time of adjacent horizontal well pairs 100 as the gravity-controlled process continues to be operated throughout its various stages. Referring to FIG. 2*a*, a first mobilized zone 110 extends between a first injection well 120 and a first production well 130 completed in a first production well completion interval 135 and into the subterranean reservoir 20, the first injection well 120 and the first production well 130 forming a first injector-producer well pair 140. A second mobilized zone 150 extends between a second injection well 160 and a second production well 170 completed in a second production well completion interval 175 and into the subterranean reservoir 20, the second injection well 160 and the second production well 170 forming a second injector-producer horizontal well pair 180.

Thus, as illustrated in FIG. 2*a*, the first mobilized zone 110 and the second mobilized zone 150 are initially independent and isolated from each other, with no fluid communication between the first mobilized zone 110 and the second mobilized zone 150.

Over time, as illustrated in FIG. 2*b*, lateral and upward progression of the first mobilized zone 110 and the second mobilized zone 150 leads to their merger, resulting in fluid communication between the first mobilized zone 110 and the second mobilized zone 150, referred to herein as a common mobilized zone 190.

Referring to FIG. 2*c*, at some point the performance characteristics of the well pairs within the common mobilized zone begin to deteriorate. Typically this would be evidenced by increasing steam-oil ratio, or decreasing oil production, or both. As illustrated in FIG. 2*c*, at this stage of operations, a significant quantity of hydrocarbon in the form of the bitumen or heavy oil 10 remains unrecovered in a bypassed region 200 situated between the adjacent horizontal well pairs 100.

Single Infill Well

FIG. 3 illustrates application of a method including operation of a single infill well. The method involves drilling and activation of a single infill well 210 located between two adjacent well pairs, the timing of the activation of the infill well being such that it must await the formation of a common mobilized zone 190.

FIG. 4 illustrates communication between the single infill well 210 and the common mobilized zone 190, resulting in the single infill well 210 and the common mobilized zone 190 forming a single thermal and hydraulic unit operated under a gravity-dominated flow process. This communication follows operation of the single infill well to establish fluid communication with the common mobilized zone.

Operation of Two to four Infill Production Wells

FIG. 5 illustrates two horizontal infill wells 210 and 211 completed in respective completion intervals 220 and 221 in a bypassed region 200. Two horizontal infill wells 210 and 211 are illustrated, but as detailed below, more than two horizontal infill wells 210 and 211 may be used. The bypassed region 200 is formed when a first mobilized zone of a first injector-producer well pair (the first well pair including a first injector well 120 and a first producer well 130) merges with a second mobilized zone of a second injector-producer well pair (the second well pair including a second injector well 160 and a second producer well 170) to form a common mobilized zone 190. The first and second injector-producer well pairs are adjacent well pairs. The spacing between adjacent well pairs may be, for example, between 90 and 260 meters, but is preferably either 100 or 120 meters. Typically, the completion intervals 220 and 221 will be similar to each other, but need not be.

The location and shape of the bypassed region 200 may be determined by computer modeling, seismic testing, or other means known to one skilled in the art.

Timing of operations of the infill wells 210 and 211 is such that the infill wells are not activated until after the mobilized zones of the adjacent well pairs have merged so as to form a common mobilized zone 190. Formation of the common mobilized zone 190 may be coincident with a given percentage recovery of the producible hydrocarbon in place, for example between about 40% and about 45% (the producible hydrocarbon in place may commonly be expressed as producible oil in place, or POIP). This approximation is useful for a number of reasons, including that the amount of time that passes between fluid communication between adjacent horizontal well pairs at their toes (which occurs earlier) and at their heels (which occurs later) may be approximately one year. Further, waiting until between about 50% and about 60% of the producible hydrocarbon in place has been produced may be less economic. While it is possible to wait for a period sufficiently long after the hydraulic merger that well performance deteriorates, or even to wait for a period sufficiently long that the economic life of the gravity-controlled recovery process comes to an end, it may not be necessary or economically prudent.

While shown as horizontal, the infill wells 210 and 211 may be vertical or horizontal or slanted or combinations thereof. Typically, the horizontal infill wells 210 and 211 will have completion intervals 220 and 221 respectively within the bypassed region 200 and will be at a level or depth which is comparable to that of the adjacent horizontal production wells, first production well 130 and second production well 170, having regard to constraints and considerations related to lithology and geological structure in that vicinity, as is known to one ordinarily skilled in the art.

The infill wells 210 and 211 are typically, though not necessarily, horizontal wells whose trajectories are generally parallel, at least in their completion intervals 220 and 221, to the adjacent injector-producer well pairs 100 that are operating under a gravity-controlled process. Also typically, the respective completion intervals 220 and 221 of the infill wells 210 and 211 are situated vertically at more or less the same elevation or depth as the first production well completion interval or the second production well completion interval. Alternatively, either or both of the infill wells 210 and 211, may be vertical wells, slanted wells, or any combination of horizontal and vertical wells.

In the embodiment where the infill wells 210 and 211 are horizontal and parallel, the lateral distance between the infill wells 210 and 211 can be, but need not be, identical to the lateral distance from an infill well to its nearest well pair. That is, where there are two infill wells 210 and 211 the lateral distance between well pairs can be, but need not be, trisected by the infill wells 210 and 211. While uniformity of spacing may be suitable in many circumstances, reservoir lithology may suggest, or operational constraints may dictate, a non-uniform spacing in certain circumstances.

Timing of the inception of operations at the infill wells 210 and 211 may be dictated by economic considerations or operational preferences. Thus, in some circumstances it may be appropriate to initiate the operation of the infill wells 210 and 211 after the adjacent well pairs 100 are at or near the end of what would be their economic lives if no further action were taken. In other circumstances it may be advisable to initiate the operation of the infill wells 210 and 211 at a distinctly earlier stage in the life of the adjacent well pairs 100. An embodiment of the method of the present invention includes establishment of fluid communication between the common mobilized zone 190 and the infill wells 210 and 211. In this embodiment, formation of the common mobilized zone 190 must precede operation of the infill wells 210 and 211 to establish fluid communication between the infill wells 210 and 211 and the common mobilized zone 190.

If, at the outset of infill well operations, the bypassed region 200 surrounding the infill wells 210 and 211 contains mobile hydrocarbons, the infill wells 210 and 211 may be placed on production from the outset. Hydrocarbons may be produced from the infill wells 210 and 211 either through a cyclic, continuous, or intermittent production process.

Infill Well Production from the Bypassed Region Only

Two to four infill wells, for example two infill wells 210 and 211, may be operated to produce hydrocarbons from the bypassed region 200 while hydrocarbons are produced from the common mobilized zone 190 are by operation of the first production well 130 and the second production well 170. Operation of the infill wells 210 and 211 may be ceased when the SOR reaches a selected value. The selected value of the SOR may be selected, for example, based on economic considerations.

Operation of the infill wells 210 and 211 may include injection of a mobilizing fluid. Injection of the mobilizing fluid may be ceased when fluid communication is established between the bypassed region 200 and the common mobilized zone 190.

Fluid Communication Between the Common Mobilized Zone and the Infill Wells

Figure 6:
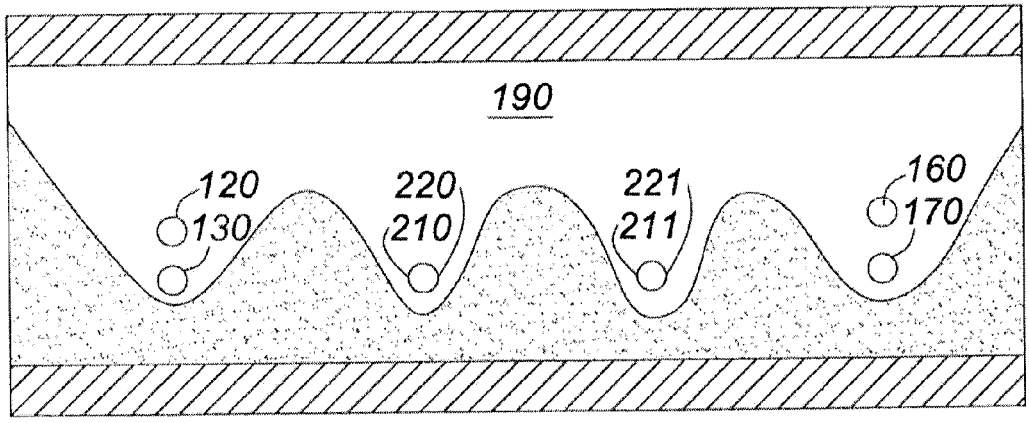
FIG. 6 is a cross-section view depicting an embodiment of the present invention, including a common mobilized zone resulting from merger of mobilized zones of adjacent well pairs, and with two infill wells in a bypassed region between the two adjacent well pairs, wherein the infill wells are in fluid communication with the common mobilized zone.

FIG. 6 illustrates fluid communication between the completion interval 220 and 221 of the respective infill wells 210 and 211, on the one hand, and the common mobilized zone 190 on the other. The infill wells 210 and 211 are operated to establish and/or increase fluid communication between the completion interval 220 and 221 of the respective infill wells 210 and 211, on the one hand, and the common mobilized zone 190 on the other. Such operation of the infill wells 210 and 211 may be joint or individual.

Once fluid communication is established between the completion interval 220 and 221 of the respective infill wells 210 and 211, on the one hand, and the common mobilized zone 190 on the other, the infill wells 210 and 211 and the adjacent well pairs are operated under a substantially gravity-controlled recovery process and hydrocarbons are recovered from the infill wells 210 and 211, from the first producer well 130, and from the second producer well 170. Operation of the infill wells 210 and 211 under a substantially gravity-controlled recovery process may be joint or individual.

A feature of the recovery process described in an embodiment of the present invention is the continuation of a dominant gravity control mechanism after fluid communication has been established between the infill wells 210 and 211 and the adjacent well pairs 100, which adjacent well pairs 100 are themselves already in communication via the common mobilized zone 190. Thus, instead of SAGD, some other analogous gravity-controlled process might be utilized. Typically, such a process might employ a combination, or range of combinations, of light hydrocarbons and heated aqueous fluid. Irrespective of the particular combination of such injected fluids, the method of an embodiment of the present invention requires formation of the common mobilized zone 190 prior to operation of the infill wells 210 and 211 to establish fluid communication between the infill wells 210 and 211 and the common mobilized zone 190, and subsequent operation of the infill wells 210 and 211, and the adjacent well pairs 100, as a single unit under a predominantly gravity-controlled process.

While use of two to four infill wells (for example two infill wells 210 and 211) may be made at typical pay thicknesses of a subterranean reservoir 20, it is preferable where the pay thickness of the subterranean reservoir 20 is at least 25 meters, and more preferably at least 35 meters.

Injection of Mobilizing Fluid Through the Infill Wells

Referring to FIGS. 5 and 6, the completion intervals 220 and 221 of the respective infill wells 210 and 211 in the bypassed region 200 will typically not initially be surrounded by or in substantial contact with hydrocarbons that have been mobilized to any sufficient degree. If there are no mobile hydrocarbons in the immediate vicinity of the infill wells 210 and 211, a mobilizing fluid, or fluid combination, may be injected into either or both of infill wells 210 and 211, each being operated individually either through a cyclic, continuous, or intermittent injection process, or by circulation.

The infill wells 210 and 211 may be operated; either individually or in concert, through production, injection, or a combination of the two. That is, the infill wells 210 and 211, operating either individually or in concert, may be used to inject the mobilizing fluid or fluids into the subterranean reservoir 20, or the wells 210 and 211, either individually or in concert, may be used to produce the hydrocarbon in the form of bitumen or heavy oil 10 from the subterranean reservoir 20 or both. Individual operation of the infill wells 210 and 211 is a reference to sequential operation of the infill wells 210 and 211, and not continuous operation of one infill well to the continuous exclusion of the other infill well.

The manner in which the mobilizing fluid 230 is injected into the infill wells 210 and 211, either individually or in concert may vary depending on the situation. For example, a cyclic stimulation approach can be used whereby injection of the mobilizing fluid is followed by production from the infill wells 210 and 211, thereby ultimately creating a pressure sink which will tend to draw in mobilized fluids from the common mobilized zone 190 and thereby establish hydraulic communication between the infill wells 210 and 211 and the common mobilized zone 190. Alternatively, a mobilizing fluid 230 could be injected into the infill wells 210 and 211 on a substantially continuous or intermittent basis until a suitable degree of communication between the infill wells 210 and 211 and the common mobilized zone 190 is attained.

Timing of Operation of the Infill Wells

In one embodiment, when the infill wells 210 and 211 have attained a suitable level of fluid communication with the common mobilized zone 190, extension of the gravity-controlled recovery process to include the infill wells 210 and 211 as production wells may begin. Any attempt to establish fluid communication between the infill wells 210 and 211 on the one hand, and the adjacent well pairs 100 on the other, must await the prior merger of the mobilized zones of those adjacent well pairs (the first mobilized zone 110 and the second mobilized zone 150 of FIG. 2*a*). That is, the method of the an embodiment present invention requires formation of the common mobilized zone 190 prior to operation of the infill wells 210 and 211 to establish fluid communication between the infill wells 210 and 211 and the common mobilized zone 190.

If the infill wells 210 and 211 are activated too early relative to the depletion stage of the adjacent well pairs operating under a gravity-controlled process, the infill wells 210 and 211, though possibly capable of some production, will not necessarily share at that stage in the benefits of being a producer in a gravity-controlled process. That is, premature activation of any infill wells may prevent or inhibit hydraulic communication, or may result in communication in which the flow from the adjacent well pairs to the infill wells is due to a displacement mechanism rather than to a gravity-control mechanism. To the extent that a displacement mechanism is operative at the expense of a gravity-control mechanism, recovery efficiency will be correspondingly compromised if either or both of the infill wells 210 and 211 are converted from an injection well to a production well before the common mobilized zone 190 is established.

After establishment of fluid communication between the common mobilized zone 190 and the infill wells 210 and 211, the infill wells 210 and 211 are produced predominantly by gravity drainage, typically along with continued operation of the adjacent first injector-producer well pair 140 and the second injector-producer well pair 180 that are also operating predominantly under gravity drainage. The infill wells 210 and 211, although offset laterally from the overlying first injection well 120 and the second injection well 160, are nevertheless able to function as producers that operate by means of a gravity-controlled flow mechanism much like the adjacent well pairs. This is because inception of operations at the infill wells 210 and 211 is designed to foster fluid communication between the infill wells 210 and 211, on the one hand, and the adjacent well pairs 100, on the other, so that the aggregate of both the infill wells 210 and 211, and the adjacent well pairs 100, functions effectively as a hydraulic unit under a gravity-controlled recovery process.

Injection of Gas

It is known to those practiced in the art that a gravity-controlled process utilizing a particular mobilizing fluid, such as steam in the case of SAGD, or a set of mobilizing fluids in place of a single fluid, need not continue to use those fluids, or need not continue to use those fluids exclusively, throughout the life of the process wells. Thus, for example, in the case of SAGD, it is often prudent to curtail or even halt the injection of steam at a certain point in the life of the process, and inject an alternative or concurrent fluid, such as natural gas, all the while maintaining gravity control. The net effect of this type of operation is a sustenance of productivity relative to that achievable if steam injection is simply terminated, and a consequent increase in energy efficiency as a result of the reduction in cumulative steam-oil ratio. In the case of natural gas injection, this technique will affect the pressure and temperature distribution within the chambers, and between them if they are in communication. However, the fundamental nature of the recovery process as one which is dominated by a gravity-controlled mechanism remains unchanged. Thus, in this type of situation, with alternative or concurrent fluid injection, the placement and operation of infill wells in the manner described above, with establishment of an aggregate of wells that are in hydraulic communication and functioning predominantly under gravity control, will represent an embodiment of the invention.

An embodiment of the present invention involves termination or interruption of steam injection with subsequent injection of a gas. The injection of a gas, such as but not restricted to natural gas, following steam injection helps to maintain pressure so that heated oil within the common mobilized zone 190 may be produced without need of additional steam injection and resulting excessive steam-oil ratios. This gas injection follow-up to steam injection in a SAGD operation is applicable to an embodiment of the present invention, as well as to conventional SAGD operations.

Well Completion

In an embodiment of this invention, the mobilizing fluid is predominantly steam, and the first production well 110 and the second production well 170 are substantially horizontal. Preferably, the gravity-controlled process under which the adjacent well pairs 100 operate is SAGD. As such, the production well is offset from the injection well in a substantially vertical direction by an interval whose magnitude is determined by those skilled in the art. Unless otherwise constrained by lithologic or structural considerations, the horizontal infill wells would each be of a length comparable to those of the initial SAGD wells and would be substantially parallel to them. In this embodiment, which involves two infill wells, placement of the infill wells 210 and 211 should be dictated by the stage of depletion of the SAGD mobilized zones, otherwise referred to as SAGD chambers, again constrained by considerations of reservoir lithology and structure.

Operation

Operation of the horizontal infill wells 210 and 211 would be initiated having regard to the economically optimum time to begin capture of the otherwise unrecovered hydrocarbon in the bypassed region 200, subject to the constraint that said operation would commence only after a common mobilized zone 190 has formed between the adjacent well pairs 100. Cyclic steam stimulation may be initiated at either or both of the infill wells 210 and 211, with the size of cycle estimated based on design considerations relating to attainment of hydraulic communication between the infill wells 210 and 211, on the one hand, and the adjacent well pairs 100, on the other, which adjacent well pairs 100 would already be in communication with each other through their merged mobilized zones, forming the common mobilized zone 190. Production will follow at both infill wells 210 and 211.

It should be noted that while a preferred embodiment of this invention involves horizontal infill wells 210 and 211 which are approximately parallel to the horizontal adjacent production well and injection well, this need not be the case. For example, the infill wells 210 and 211 could be drilled so that they are not parallel to the adjacent well pairs. For example the infill wells may be oriented at right angles or some other angle to a group of adjacent well pairs.

Dilation of Fracturing of the Reservoir

At the outset of infill well operations, there may be insufficient mobility in the reservoir surrounding the infill wells to permit steam injection into the reservoir matrix at practical rates without disrupting the fabric of the reservoir matrix. In this event, those practiced in the art will recognize that alternative modes of achieving hydraulic communication with the adjacent common mobilized zone 190 are available. One such mode involves injecting into either or both of the infill wells 210 and 211 at sufficiently high pressures to effect a parting, dilation or fracturing of the subterranean reservoir matrix, thereby exposing a larger area across which flow into the hydrocarbon formation can take place. In some hydrocarbon formations, the water saturation within the reservoir matrix may be sufficiently high to provide a high mobility path along which hydraulic communication may be easily established without need of high pressure techniques. Another mode of achieving hydraulic communication involves circulating steam within the tubulars of either or both of the infill wells 210 and 211 to heat the surrounding hydrocarbon formation initially by conduction. Still another mode involves injecting a hydrocarbon solvent at either or both of the infill wells 210 and 211.

SAGD Heel Oil

In another embodiment, either or both of the infill wells 210 and 211 may be located and oriented no that they capture oil that is located in or proximate to the region of the heels of the adjacent horizontal well pairs 100.

Three Infill Production Wells

Figure 7:
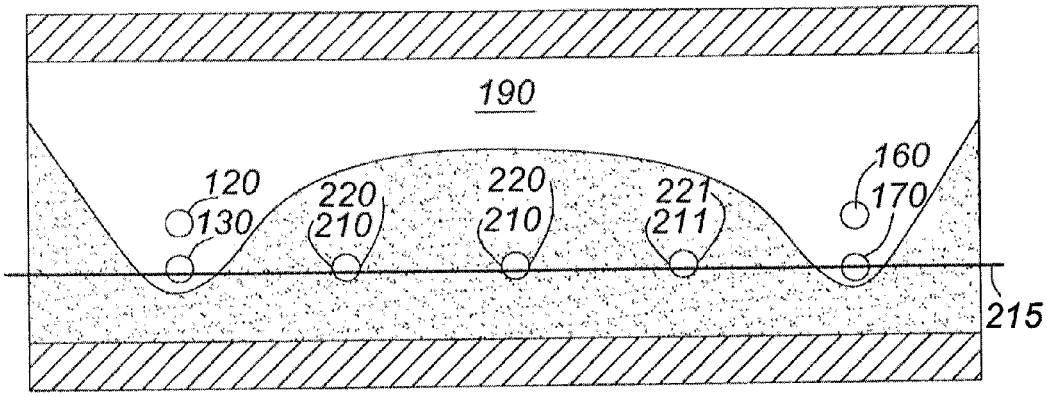
FIG. 7 is a cross-section view, as in FIG. 5, depicting an embodiment of the present invention, including a common mobilized zone resulting from merger of mobilized zones of adjacent well pairs, and with three infill wells in a bypassed region between the two adjacent well pairs, wherein the infill wells are not yet in fluid communication with the common mobilized zone.

FIG. 7 illustrates three infill wells 210, 211, and 212 between adjacent well pairs, the adjacent well pairs respectively including a first injector well 120 and a first producer well 130, and a second injector well 160 and a second producer well 170. The three infill wells 210, 211, and 212 have respective completion intervals 220, 221, and 222. The respective mobilized zones of the adjacent well pairs have merged to form a common mobilized zone 190, but fluid communication has not been established between the completion intervals 220, 221, and 222, on the one hand, and the common mobilized zone 190 on the other hand. The three infill wells include a first outer infill well 210, a second outer infill well 212, and a central infill well 211. The first outer infill well 210 is located between the first producer well 130 and the central infill well 211. The second outer infill well 212 is located between the second producer well 170 and the central infill well 211.

Figure 8:
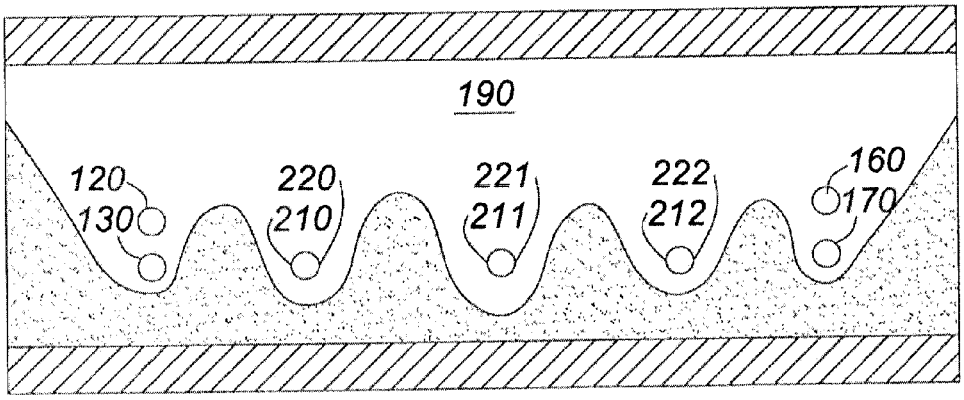
FIG. 8 is a cross-section view, as in FIG. 6, depicting an embodiment of the present invention, including a common mobilized zone resulting from merger of mobilized zones of adjacent well pairs, and with three infill wells in a bypassed region between the two adjacent well pairs, wherein the infill wells are in fluid communication with the common mobilized zone.

FIG. 8 illustrates three infill wells 210, 211, and 212 wherein fluid communication has been established between the completion intervals 220, 221, and 222, on the one hand, and the common mobilized zone 190 on the other hand.

Elevated Central Well

The first outer infill well 210, the second outer infill well 212, the first producer well 130, and the second producer well 170 are all located at a depth 215. The central infill well 211 may also be located at the depth 215. Alternatively, the central infill well may be located at a depth closer to the surface than the depth 215, for example by between about two and about four meters.

Staged Startup of Three Infill Wells

A mobilizing fluid may be injected through one or more of the three infill wells 210, 211, and 212 to establish fluid communication between the completion intervals 220, 221, and 222 on the one hand, and the common mobilized zone 190 on the other hand. Mobilizing fluid may be injected through the central infill well 211 prior to operation of the first outer infill well 210 or the second outer infill well 212 (and operation of the central infill well 211 as a producer). Injection of mobilizing fluid through the central infill well 211 prior to operation of the first outer infill well 210 or the second outer infill well 212 is referred to as staged startup. Staged startup of the central infill well 211 is desirable when, for example, production is observed at the first outer infill well 210 or the second outer infill well 212 but not at the central infill well 211. Staged startup may typically have a duration of between 30-40 days.

Four Infill Production Wells

Figure 9:
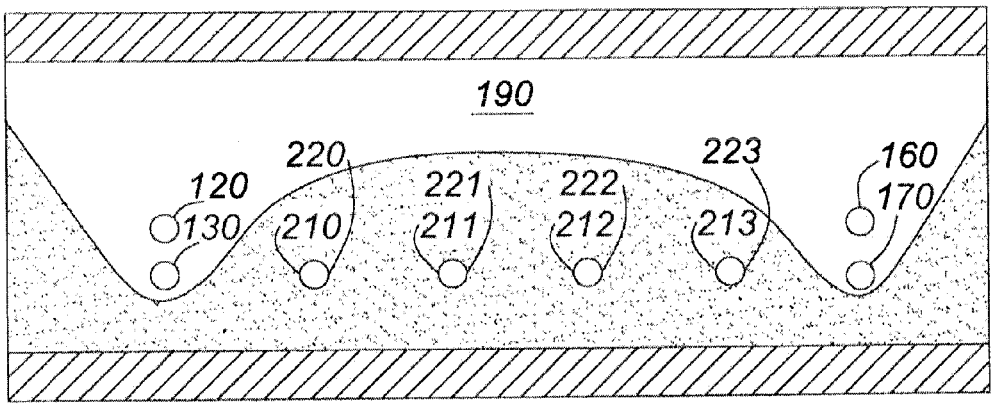
FIG. 9 is a cross-section view, as in FIG. 5, depicting an embodiment of the present invention, including a common mobilized zone resulting from merger of mobilized zones of adjacent well pairs, and with four infill wells in a bypassed region between the two adjacent well pairs, wherein the infill wells are not yet in fluid communication with the common mobilized zone.

FIG. 9 illustrates four infill wells 210, 211, 212, and 213 between adjacent well pairs, the adjacent well pairs respectively including a first injector well 120 and a first producer well 130, and a second injector well 160 and a second producer well 170. The four infill wells 210, 211, 212, and 213 have respective completion intervals 220, 221, 222, and 223. The respective mobilized zones of the adjacent well pairs have merged to form a common mobilized zone 190, but fluid communication has not been established between the completion intervals 220, 221, 222, and 223 on the one hand, and the common mobilized zone 190 on the other hand. The four infill wells include a first outer infill well 210, a second outer infill well 213, a first central infill well 211, and second central infill well 212. The first outer infill well 210 is located between the first producer well 130 and the first central infill well 211. The second outer infill well 213 is located between the second producer well 170 and the second central infill well 212.

Figure 10:
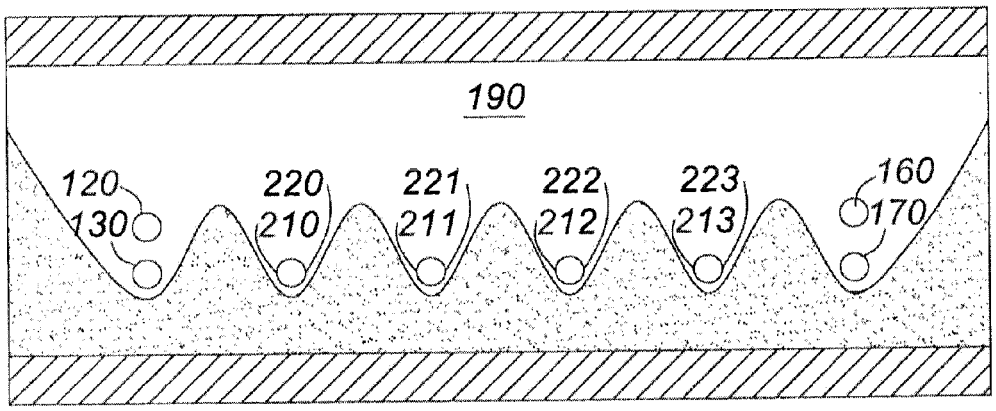
FIG. 10 is a cross-section view, as in FIG. 6, depicting an embodiment of the present invention, including a common mobilized zone resulting from merger of mobilized zones of adjacent well pairs, and with four infill wells in a bypassed region between the two adjacent well pairs, wherein the infill wells are in fluid communication with the common mobilized zone.

FIG. 10 illustrates four infill wells 210, 211, 212, and 213 wherein fluid communication has been established between the completion intervals 220, 221, 222, and 223, on the one hand, and the common mobilized zone 190 on the other hand.

Staged Startup of Four Infill Wells

A mobilizing fluid may be injected through one or more of the four infill wells 210, 211, 212, and 213 to establish fluid communication between the completion intervals 220, 221, 222, and 223 on the one hand, and the common mobilized zone 190 on the other hand. Mobilizing fluid may be injected through one or more of the first central infill well 211 and the second central infill well 212 prior to operation of the first outer infill well 210 or the second outer infill well 213 (and operation of the first central infill well 211 and the second central infill well 212 as producers). Injection of mobilizing fluid through one or more of the first central infill well 211 and the second central infill well 212 prior to operation of the first outer infill well 210 or the second outer infill well 213 is referred to as staged startup. Staged startup of one or more of the first central infill well 211 and the second central infill well 212 is desirable when, for example, production is observed at the first outer infill well 210 or the second outer infill well 213 but not at one or more of the first central infill well 211 or second central infill well 212. Staged startup may typically have a duration of between 30-40 days.

Vertical Infill Wells

Figure 11:
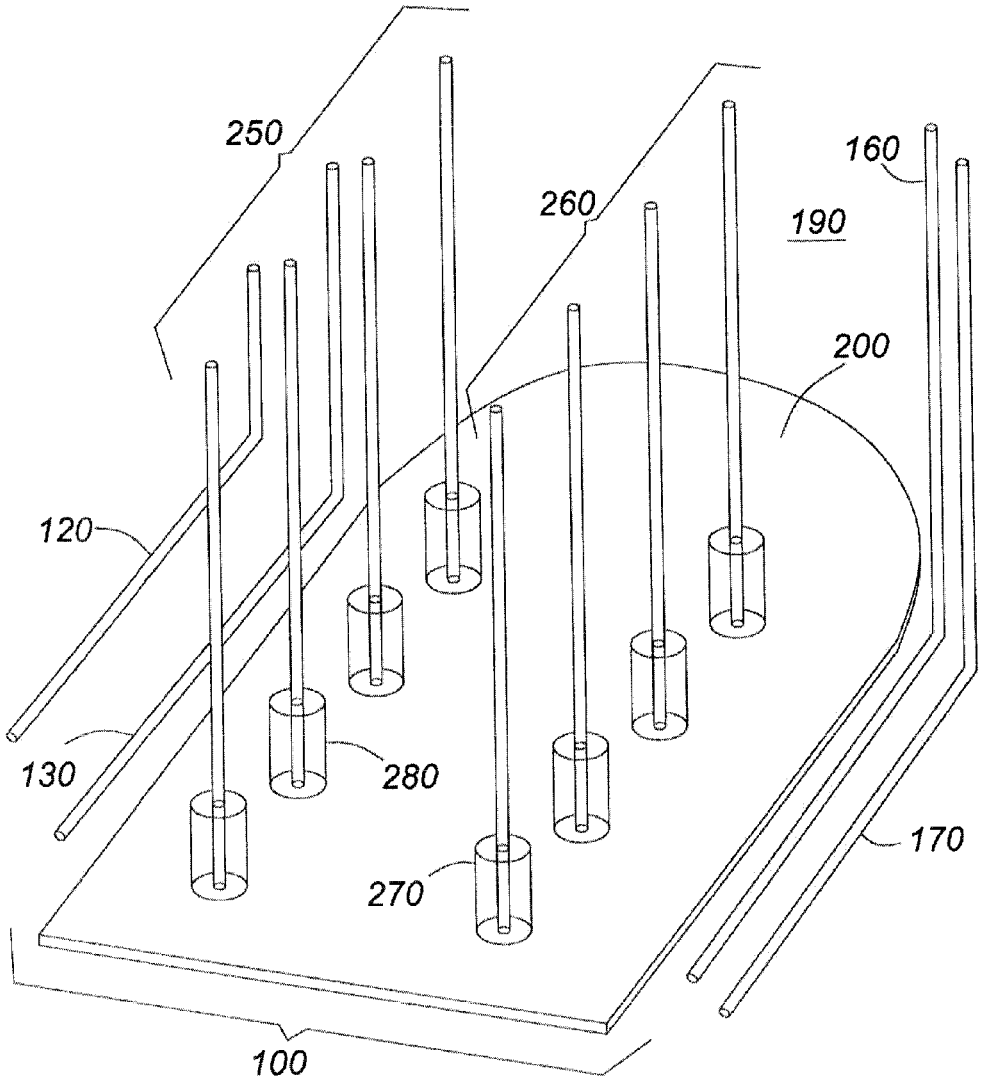
FIG. 11 is an isometric view of two series of vertical infill wells between adjacent well pairs, the vertical infill wells having completion intervals in a bypassed region formed when the respective mobilized zones of the adjacent well pairs merge to form a common mobilized zone.

FIG. 11 is a first series 250 and a second series 260 of vertical infill wells 270 between a first injector-producer well pair having a first injector well 120 and a first producer well 130, and a second injector-producer well pair having a second injector well 160 and a second producer well 170, the first injector-producer well pair and the second injector-producer well pair together being adjacent well pairs 100. The effect of two to four infill wells may be approximated by providing two to four series (here 250 and 260) of vertical infill wells 270 wherein each vertical infill 270 well has a completion interval 280 in a bypassed region 200, the bypassed region formed when the respective mobilized zones of the adjacent well pairs merge to form a common mobilized zone 190.

In another embodiment, instead of, or in addition to a horizontal infill well 210 or a horizontal infill well 211, or both, a first series 250 of vertical wells 270 and a second series 260 of vertical wells 270 may be drilled and completed such that, in aggregate, they perform the same function as an equivalent horizontal infill well or wells. That is, the series 250 and 260 of vertical wells 270 achieve communication with adjacent well pairs 100 that are themselves in prior hydraulic communication forming a common mobilized zone, and the series 250 and 260 of vertical wells 270 facilitate recovery of hydrocarbons, that would have otherwise been by-passed, under a predominantly gravity-controlled process.

This type of well configuration may be used, for example, where previously by-passed hydrocarbons that are to be recovered are distributed in a non-uniform or irregular manner. Vertical infill wells 270, with appropriate completions 280, may capture hydrocarbons more efficiently than would two to four horizontal infill wells.

Simulation Data

Performance of an embodiment of the present invention has been simulated mathematically. The simulated embodiment of the method of the present invention includes establishment of fluid communication between a common mobilized zone and between two and four infill wells. Formation of the common mobilized zone must precede operation of the infill wells to establish fluid communication between the infill wells and the common mobilized zone. In the simulations, steam is injected through the infill wells until fluid communication is established between the infill wells and the common mobilized zone, then all steam injection is stopped, and a gas such as methane is injected to maintain the pressure of the reservoir while production is maintained at the infill wells and the producer wells. All simulations were terminated when a comparison of the cost of operation to the value of a barrel of oil is no longer favorable. Values of economic parameters used in the simulation are provided below in Table 1:

TABLE 1

| Empirical Coefficient | Value | |
|---|---|---|
| Infill Well Cost | $2,500,000* | |
| SAGD Well Cost | $1,250,000** | |
| Oil Netback | (see Tables 2 and 3) | |
| SOR Multiplier | 10 | |
| Cumulative Discount Factor | 0.56*** | 0.47**** |

*Adjusted for estimated increase in cost over time
**Adjusted to reflect half cost at no-flow boundaries
***For 120 m well spacing simulations (Table 2)
****For 240 m well spacing simulations (Table 3)

Table 2 compares the values of CSOR. Ri, and NPV (at various netback values) wherein between 0 and 4 infill wells are provided between two horizontal well pairs with steam as the mobilizing fluid and 120 m spacing between adjacent well pairs. Table 2 also provides the above values for 3 infill wells wherein a central infill well has a staged startup and wherein the central infill well is elevated relative to the remaining infill wells (outer infill wells).

TABLE 2

| Infill Wells | CSOR | Cum Oil (MMBbl)* | Ri (%) | NPV (MM$) with indicated netback ($/bbl) 20 | 30 | 40 | 50 | 60 |
|---|---|---|---|---|---|---|---|---|
| 0 | 1.30 | 3.38 | 71.30 | 19.86 | 38.78 | 57.74 | 76.64 | 95.57 |
| 1 | 1.22 | 3.59 | 75.80 | 20.51 | 40.61 | 60.72 | 80.82 | 100.92 |
| 2 | 1.19 | 3.68 | 77.80 | 19.32 | 39.92 | 60.53 | 81.14 | 101.75 |
| 3 | 1.18 | 3.72 | 78.60 | 17.36 | 38.20 | 59.03 | 79.86 | 100.69 |
| 4 | 1.17 | 3.74 | 78.95 | 15.19 | 36.13 | 57.08 | 78.02 | 98.96 |
| 3** | 1.24 | 3.75 | 79.10 | 17.10 | 38.10 | 59.10 | 80.10 | 101.10 |
| 3*** | 1.14 | 3.65 | 77.00 | 16.98 | 37.42 | 57.86 | 78.30 | 98.74 |

*Per 120 m Spacing
**Central Infill Well on Staged Startup
***Central Infill Well Elevated by 2-4 m As shown in Table 2, operation of between two and four infill wells provides more desirable Ri and CSOR values as compared to one infill well. As the netback increases, operation of two infill wells provides more desirable NPV than operation of one infill well.

Performance of the present invention has also been simulated mathematically for the two horizontal well pairs with steam as the mobilizing fluid and 240 m spacing between adjacent well pairs. Table 3 compares the values of CSOR, Ri, and NPV (at various netback values) wherein between 0 and 4 infill wells are provided. Table 3 also provides the above values for 3 infill wells wherein a central infill well has a staged startup, and for 4 infill wells wherein a first central infill well and a second central infill well each have a staged startup.

TABLE 3

| Infill Wells | CSOR | Cum Oil (MMBbl)* | Ri (%) | NPV (MM$) with indicated netback ($/bbl) 20 | 30 | 40 | 50 | 60 |
|---|---|---|---|---|---|---|---|---|
| 0 | 1.65 | 2.98 | 62.80 | 34.52 | 62.54 | 90.55 | 118.56 | 146.57 |
| 2 | 1.47 | 3.36 | 70.90 | 38.47 | 70.05 | 101.64 | 133.22 | 164.80 |
| 3 | 1.44 | 3.43 | 72.30 | 37.58 | 69.83 | 102.07 | 134.31 | 166.55 |
| 4 | 1.40 | 3.52 | 74.25 | 37.18 | 70.26 | 103.35 | 136.44 | 169.53 |
| 3** | 1.43 | 3.56 | 75.00 | 40.13 | 73.59 | 107.06 | 140.52 | 173.98 |
| 4*** | 1.39 | 3.64 | 76.89 | 39.53 | 73.75 | 107.96 | 142.18 | 176.4 |

*Per 120 m Spacing
**Central Infill Well on Staged Startup
***Both Central Infill Wells on Staged Startup As shown in Table 3, the most desirable CSOR and Ri values are obtained when four infill wells are operated with both central infill wells having staged production, and the most desirable NPV is obtained under these circumstances for simulations having tested netback values greater than 20 $/bbl.

In the preceding description, for purposes of explanation, numerous details are set forth in order to provide a thorough understanding of the embodiments. However, it will be apparent to one skilled in the art that these specific details are not required. In other instances, well-known structures are shown schematically in order not to obscure the understanding.

The above-described embodiments are intended to be examples only. Alterations, modifications and variations can be effected to the particular embodiments by those of skill in the art without departing from the scope, which is defined solely by the claims appended hereto.

What is claimed is:

1. A method of producing hydrocarbons from a subterranean reservoir, comprising:

a. operating a first injector-producer well pair under a substantially gravity-controlled recovery process, the first injector-producer well pair forming a first mobilized zone in the subterranean reservoir, the first injector-producer well pair comprising a first substantially horizontal injector well and a first substantially horizontal producer well;

b. operating a second injector-producer well pair under a substantially gravity-controlled recovery process, the second injector-producer well pair forming a second mobilized zone in the subterranean reservoir, the second injector-producer well pair comprising a second substantially horizontal injector well and a second substantially horizontal producer well, the first injector-producer well pair and the second injector-producer well pair together being adjacent well pairs;

c. providing two to four infill substantially horizontal producer wells in a bypassed region, the bypassed region having formed between the adjacent well pairs when the first mobilized zone and the second mobilized zone merge to form a common mobilized zone;

d. operating the two to four infill producer wells to establish fluid communication between the two to four infill producer wells and the common mobilized zone;

e. operating the two to four infill producer wells and the adjacent well pairs under a substantially gravity-controlled recovery process; and f. recovering hydrocarbons from the two to four infill producer wells, and from the first producer well and the second producer well.

2. The method of claim 1 wherein the two to four infill producer wells comprise two infill producer wells.

3. The method of claim 1 wherein the two to four infill producer wells comprise three infill producer wells.

4. The method of claim 3 wherein the three infill producer wells comprise two outer infill wells and a central infill producer well, and further comprising injecting a mobilizing fluid through the central infill producer well prior to operating the three infill producer wells and the adjacent well pairs under a substantially gravity-controlled recovery process.

5. The method of claim 3 wherein:

a. the first producer well is at a first depth;

b. the second producer well is at the first depth; and c. the three infill producer wells comprising two outer infill wells and a central infill producer well, the two outer infill wells being located at a substantially similar depth to the first depth, and the central infill producer well being located at a second depth, the second depth being closer to the surface than the first depth.

6. The method of claim 5 wherein the second depth is between about two and about four meters closer to the surface than the first depth.

7. The method of claim 1 wherein the two to four infill producer wells comprise four infill producer wells.

8. The method of claim 7 wherein the four infill producer wells comprise two outer infill wells and two central infill producer wells, and further comprising injecting a mobilizing fluid through one or more of the two central infill producer wells prior to operating the four infill producer wells and the adjacent well pairs under a substantially gravity-controlled recovery process.

9. The method of claim 1 wherein the subterranean reservoir has a pay thickness of at least 25 meters.

10. The method of claim 1 wherein the pay thickness is at least 35 meters.

11. The method of claim 1 wherein the adjacent well pairs are separated by a distance of between substantially 90 and substantially 130 meters.

12. The method of claim 1 wherein the adjacent well pairs are separated by a distance of substantially 100 or substantially 120 meters.

13. The method of claim 1 wherein the adjacent well pairs are separated by a distance of between substantially 180 and substantially 260 meters.

14. The method of claim 1 wherein the adjacent well pairs are separated by a distance of substantially 200 or substantially 240 meters.

15. The method of claim 1, wherein the two to four infill producer wells are operated jointly to establish fluid communication between the two to four infill producer wells and the common mobilized zone.

16. The method of claim 1, wherein each of the two to four infill producer wells are operated individually to establish fluid communication between the two to four infill producer wells and the common mobilized zone.

17. The method of claim 1, wherein the two to four infill producer wells are operated jointly under a substantially gravity-controlled recovery process.

18. The method of claim 1, wherein each of the two to four infill producer wells are operated individually under a substantially gravity-controlled recovery process.

19. The method of claim 1, wherein hydrocarbons are produced from the two to four infill producer wells to establish fluid communication between the two to four infill producer wells and the common mobilized zone.

20. The method of claim 1, wherein a mobilizing fluid is injected into one or more of the two to four infill producer wells to establish fluid communication between the two to four infill producer wells and the common mobilized zone.

21. The method of claim 20, wherein the mobilizing fluid comprises steam or is substantially steam.

22. The method of claim 20, wherein the mobilizing fluid is a light hydrocarbon or a combination of light hydrocarbons.

23. The method of claim 20, wherein the mobilizing fluid includes both steam and a light hydrocarbon or light hydrocarbons, either as a mixture or as a succession or alternation of fluids.

24. The method of claim 20, wherein the mobilizing fluid comprises hot water.

25. The method of claim 20, wherein the mobilizing fluid comprises both hot water and a light hydrocarbon or light hydrocarbons, introduced into the hydrocarbon formation either as a mixture or as a succession or alternation of fluids.

26. The method of claim 20, wherein the mobilizing fluid is injected at a pressure and flow rate sufficiently high to effect a fracturing or dilation or parting of the subterranean reservoir matrix outward from some or all of the infill producer wells, thereby exposing a larger surface area to the mobilizing fluid.

27. The method of claims 20, wherein the mobilizing fluid and a gaseous fluid are injected concurrently, or wherein the injection of the mobilizing fluid is terminated or interrupted, and a gaseous fluid is injected into the common mobilized zone to maintain pressure within the common mobilized zone, while continuing to produce hydrocarbons under a predominantly gravity-controlled recovery process.

28. The method of claim 27, wherein the gaseous fluid comprises natural gas.

29. The method of claim 1, wherein a mobilizing fluid is circulated through one or more of the two to four infill producer wells to establish fluid communication between the two to four infill producer wells and the common mobilized zone.

30. The method of claim 29, wherein the mobilizing fluid comprises steam.

31. The method of claim 1, wherein the gravity-controlled recovery process is Steam-assisted Gravity Drainage (SAGD).

32. The method of claim 1, wherein the trajectories of the substantially horizontal two to four infill producer wells and the adjacent well pairs are approximately parallel.

33. The method of claim 1, wherein the infill producer wells and the adjacent well pairs, constituting a well group, are provided on a repeated pattern basis either longitudinally or laterally or both, to form a multiple of well groups.

34. A method of producing hydrocarbons from a subterranean reservoir, comprising:

a. operating a first injector-producer well pair under a substantially gravity-controlled recovery process, the first injector-producer well pair forming a first mobilized zone in the subterranean reservoir, the first injector-producer well pair comprising a first substantially horizontal injector well and a first substantially horizontal producer well;

b. operating a second injector-producer well pair under a substantially gravity-controlled recovery process, the second injector-producer well pair forming a second mobilized zone in the subterranean reservoir, the second injector-producer well pair comprising a second substantially horizontal injector well and a second substantially horizontal producer well, the first injector-producer well pair and the second injector-producer well pair together being adjacent well pairs;

c. providing two to four infill substantially horizontal producer wells in a bypassed region, the bypassed region having formed between the adjacent well pairs when the first mobilized zone and the second mobilized zone merge to form a common mobilized zone;

d. recovering hydrocarbons from the bypassed region from the two to four infill producer wells; and e. recovering hydrocarbons from the first producer well and the second producer well.

35. The method of claim 34 wherein operating the adjacent well pairs and the infill wells comprises injecting steam into one or more of the wells in the adjacent well pairs and the infill wells, and further comprising ceasing to recover hydrocarbons from the bypassed region from the two to four infill producer wells when the SOR (Steam Oil Ratio) reaches a selected value.

36. The method of claim 34 wherein step d further comprises injecting a mobilizing fluid through the two to four infill producer wells.

37. The method of claim 36, further comprising ceasing to inject mobilizing fluid when fluid communication is established between the bypassed region and the common mobilized zone.

38. A method of producing hydrocarbons from a subterranean reservoir having a producible amount of hydrocarbons in place, comprising:

a. operating a first injector-producer well pair under a substantially gravity-controlled recovery process, the first injector-producer well pair forming a first mobilized zone in the subterranean reservoir, the first injector-producer well pair comprising a first substantially horizontal injector well and a first substantially horizontal producer well;

b. operating a second injector-producer well pair under a substantially gravity-controlled recovery process, the second injector-producer well pair forming a second mobilized zone in the subterranean reservoir, the second injector-producer well pair comprising a second substantially horizontal injector well and a second substantially horizontal producer well, the first injector-producer well pair and the second injector-producer well pair together being adjacent well pairs;

c. providing two to four infill substantially horizontal producer wells in a bypassed region, the bypassed region having formed between the adjacent well pairs when:

the first mobilized zone and the second mobilized zone merge to form a common mobilized zone; and between about 40 percent and about 45 percent of the producible amount of hydrocarbons in place have been recovered from the adjacent well pairs;

d. operating the two to four infill producer wells to establish fluid communication between the infill producer wells and the common mobilized zone;

e. operating the two to four infill producer wells and the adjacent well pairs under a substantially gravity-controlled recovery process; and f. recovering hydrocarbons from the two to four infill producer wells, and from the first producer well and the second producer well.

39. A method of producing hydrocarbons from a subterranean reservoir, comprising:

a. operating a first injector-producer well pair under a substantially gravity-controlled recovery process, the first injector-producer well pair forming a first mobilized zone in the subterranean reservoir, the first injector-producer well pair comprising a first injector well and a first producer well, the first injector-producer well comprising a first completion interval, the first completion interval being substantially horizontal;

b. operating a second injector-producer well pair under a substantially gravity-controlled recovery process, the second injector-producer well pair forming a second mobilized zone in the subterranean reservoir, the second injector-producer well pair comprising a second injector well and a second producer well, the second injector-producer well comprising a second completion interval, the second completion interval being substantially horizontal, the first injector-producer well pair and the second injector-producer well pair together being adjacent well pairs;

c. providing two to four series of substantially vertical infill producer wells, the completion intervals of the substantially vertical infill producer wells being in a bypassed region and approximating the effect on performance that would be achieved by the presence of two to four horizontal infill producer wells, the bypassed region having formed between the adjacent well pairs when the first mobilized zone and the second mobilized zone merge to form a common mobilized zone;

d. operating the two to four series of substantially vertical infill producer wells to establish fluid communication between the two to four infill producer wells and the common mobilized zone;

e. operating the two to four series of substantially vertical infill producer wells and the adjacent well pairs under a substantially gravity-controlled recovery process; and f. recovering hydrocarbons from the two to four series of substantially vertical infill producer wells, and from the first producer well and the second producer well.

* * * * *